United States Patent [19]

Sanders

[11] 4,372,282

[45] Feb. 8, 1983

[54] ARCHERY BOW WITH ARROW SUPPORT

[76] Inventor: Edward Sanders, P.O. Box 585, Laverne, Okla. 73848

[21] Appl. No.: 119,943

[22] Filed: Feb. 8, 1980

[51] Int. Cl.[3] ..... F41B 5/00

[52] U.S. Cl. ..... 124/24 R; 124/41 A

[58] Field of Search ..... 124/41 A, 24 R, 88, 124/86, 25

[56] References Cited

U.S. PATENT DOCUMENTS 736,051 8/1903 Adams ..... 124/88 X
3,406,675 10/1968 Fredrickson ..... 124/41 A X
3,919,997 11/1975 Day ..... 124/41 A
4,282,850 8/1981 Warnicke ..... 124/41 A X

*Primary Examiner*—Richard C. Pinkham
*Assistant Examiner*—William R. Browne
*Attorney, Agent, or Firm*—Christopher H. Morgan

[57] ABSTRACT

A device for supporting an arrow disposed in a ready-to-shoot position on an archery bow. The device has at least three contact points for contacting the arrow and completely radially supporting the arrow. Three openings are provided for receiving the rear guide fins of the arrow therethrough when the arrow is projected.

6 Claims, 4 Drawing Figures

ARCHERY BOW WITH ARROW SUPPORT

BACKGROUND OF THE INVENTION

1. Field of the Invention

This invention relates generally to archery equipment and more particularly to arrow supports for archery equipment.

2. Description of the Prior Art

A wide variety of arrow rests are known for use on or as part of archery bows. These arrow rests perform the function of at least partially supporting the mid-portion of an arrow. In general an arrow rest must support an arrow when it is held in a shooting position and when the arrow is projected or cast. Also, the arrow rest must not interfere with the drawing or release of the arrow and bow string. Further, when the arrow is projected or cast, the arrow rest must guide the arrow but not damage its shaft or vanes. Some arrow rests shown in the prior art have been moderately successful in achieving these functions.

An additional functional need for arrow rests or supports is encountered when the arrow must be held in a ready-to-draw position and the bow is tilted or rotated radially. This situation often occurs when hunting. To some extent, it also occurs during casual target practice and the like. For example, when a hunter or a target shooter needs to be ready to quickly draw and shoot an arrow, the arrow must already be nocked or time will be wasted. However, with the arrow nocked, the mid-portion of the arrow often slips from the arrow rest. Besides being an incovenience, if this slipping occurs during the time for drawing and shooting, the arrow is sure to be miscast. The likelihood of the arrow slipping from the arrow rest is especially a problem for a hunter since hunters often are in awkward positions and have other uses for their hands.

Although some arrow rests shown in the prior art provide a complete radial support of the mid-portion of an arrow, these arrow rests have not been completely satisfactory. For example, U.S. patents to Day (U.S. Pat. No. 3,919,997) and Dye (U.S. Pat. No. 3,406,676) show resilient plastic guides which snap above and below an arrow to radially support the mid-portion of the arrow. These supporting guides are glued to the side of the archery bow in a plane parallel to the axis of the arrow. Of the disadvantages of the Day and Dye inventions, the most important is the hindrance they create to the passage of the vanes or feathers disposed on the rear portion of the arrow shaft. These vanes are delicate and are easily damages. Also, this hindrance to passage of the vanes can reduce the accuracy of the arrow when it is cast. Furthermore, the Day and Dye inventions are not easily attached and removed to and from a bow.

Other U.S. patents which show arrow rests which are interesting yet unsatisfactory, for one reason or another, are Cameron (U.S. Pat. No. 1,847,593); Shankland (U.S. Pat. No. 3,225,755); Hoyt, Jr. (U.S. Pat. No. 3,292,607); and Troncosco, Jr. (U.S. Pat. No. 3,935,854). Clearly, however, these inventions do not show an arrow rest which achieves the advantages and features shown by the invention described herein.

SUMMARY OF THE INVENTION

It is accordingly an object of the present invention to provide an improved arrow rest or support, especially one completely radially supporting the mid-portion of nocked arrow in a ready-to-draw position.

It is also an object of the present invention to provide such an arrow support which is improved in the sense that it is less likely to damage the arrow when the arrow is cast.

It is also an object of the present invention to provide such an arrow rest which has improved support qualities so that the arrow can be accurately cast.

Finally, it is yet another object of the present invention to provide an arrow rest which can support an arrow as described and still be easily attached or removed with other arrow rests still in place.

In accordance with these objects the present invention provides a support for an arrow which has been nocked and is in a ready-to-draw position on an archery bow. The device comprises a frame member, and a means to connect the frame member to an archery bow. A support means is connected to the frame member for radially supporting the mid-portion of the arrow in its ready-to-draw position. The support means has at least three openings for receiving the rear guide fins of an arrow therethrough as the arrow is projected.

For a further understanding of the invention and further objects, features, and advantages thereof, reference may now be had to the following description taken in conjunction with the accompanying drawings.

DESCRIPTION OF THE PREFERRED EMBODIMENTS

Figure 1:
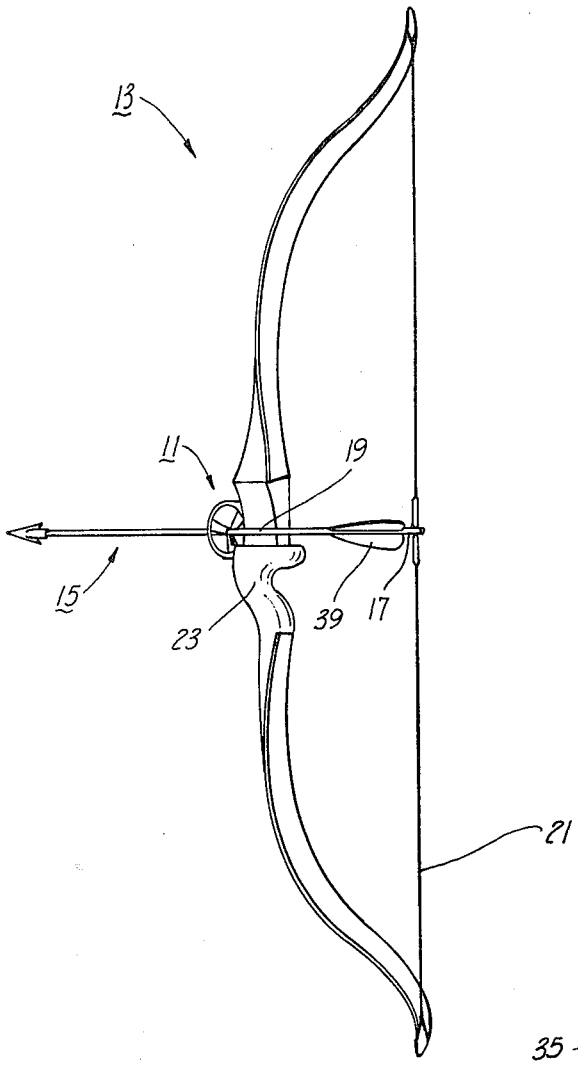
FIG. 1 is a perspective view of an archery bow and an arrow with the arrow support of the present invention.

Referring now to FIG. 1, the arrow support 11 of the present invention is shown attached to an archery bow 13. An arrow 15 is shown in a ready-to-shoot position on the bow 13. By a ready-to-shoot position it is meant that the nock 17 of the arrow is received on the nocking point of the bow string 21 and the mid-portion 19 of the arrow 15 rests above the handle 23 of bow 13. From this position the arrow is ready to be drawn and then projected or cast forward by the release of the bow string.

Figure 2:
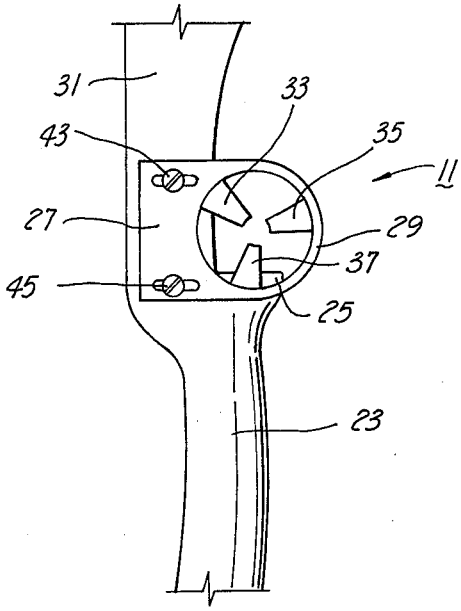
FIG. 2 is a front view of the mid-portion of the archery bow with the arrow support attached.

Referring also to FIG. 2, it can be seen that, without the present invention, the arrow 15 rests on a ledge 25 formed in the body of the bow just above the handle 23. On many bows this ledge has a resilient (often a feathered) rest on which the shaft of the arrow rests when in a ready-to-shoot position. A leather strip or the like is often glued to the horizontal shoulder just above the resilient rest to prevent the shaft of the arrow from scraping against the wood of the bow when the arrow is projected.

The arrow support 11 of the present invention performs the same functions as the feathered rest and leather strip just described, and achieves additional advantages as well. Most importantly, the arrow support 11 prevents the arrow 15 from radially slipping out of its shooting position once it is placed there. This is of great advantage whenever the arrow needs to be ready for shooting and yet the bow is likely to be oriented or tilted to positions which would cause the arrow to normally slip off of the ledge 25.

Figure 3:
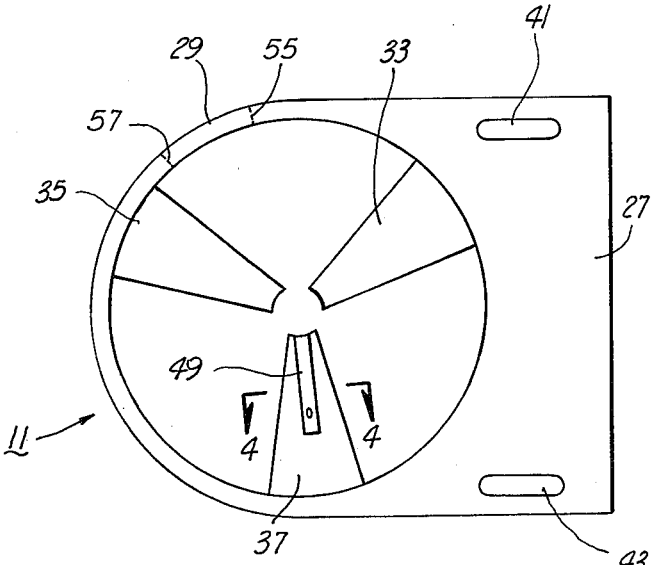
FIG. 3 is a rear view of the arrow support shown in FIG. 2 without the archery bow attached.

Referring now to FIGS. 2 and 3, it can be seen that the arrow support 11 has a frame portion 27 and a ring portion 29. The arrow support 11 is relatively flat. This allows the support to be easily connected to the back 31 of the bow 13 just above the handle 23. The frame portion 27 is a rectangular extension from the ring portion 29. When in position on the bow 13 the ring portion 29 extends out of and over the ledge 25 and the frame portion 27 extends along and abuts the back 31 which is adjacent the ledge 25. When mounted on an archery bow 13, the plane of the arrow support 11 is transverse to an arrow in ready-to-shoot position.

The ring portion 29 of arrow support 11 has a central opening through which an arrow can extend when the arrow is in a shooting position. Three wedge-shaped arm members 33, 35, and 37 extend radially inwardly into the opening in ring portion 29. The base of each of the wedge-shaped arms is connected to the interior of the ring portion 29, The radially innermost ends of the arms 33, 35 and 37 form contact points for radially supporting the mid-portion of the arrow when it is disposed in a shooting position on the bow. If desired, these contact points can be arch-shaped to conform to the outside diameter of the shaft of the arrow. The contact points should be spaced such that once the arrow is positioned between the contact points, the arrow is held in this position regardless of the radial orientation of the bow arrow and arrow support. Another way of stating this same concept is that the radial angle from each of the support arms to its neighboring support arms is less than 180°.

The spaces or openings between the arms 33, 35 and 37 are preferably disposed such that, when the arrow is projected or cast, the vanes or rear guide fins 39 of arrow 15 will pass therethrough. On most arrows these vanes or fins 39 are comprised of feathers which have been glued to the shaft of the arrow. These features are relatively delicate such that a scraping impact could damage them or tear them off. Thus, even if the support arms 33, 35 and 37 are sufficiently flexible to allow the feather to pass directly beneath the contact point by bending the respective arm, it is desirable that the feather pass through the opening between the arms.

As shown in FIGS. 2 and 3, the three arms 33, 35 and 37 are equally spaced at approximately 120° radial angles from each other. Thus, three equal openings are formed for the feather to pass through when the arrow is projected. Normally when an arrow is nocked the cock feather extends outwardly at a right angle to the left of the bowstring (on a right handed bow). The other two vanes are oriented 120° from the cock feather. This feather positioning is achieved each time the arrow is nocked. Therefore, by arranging the wedge-shaped arms 33, 35 and 37 such that they do not intersect the plane of the feathers when thus positioned, the feathers will pass through the openings between the arms when the arrow is projected.

In order to insert and remove an arrow between the contact points of the arms 33, 35 and 37 at least one of the arms must be sufficiently flexible to allow it to bend during the insertion and removal process. Most plastics can achieve this degree of flexibility. Furthermore, when the arrow is projected, some slight radial movement of the shaft is required due to the slight variations from axial projection of the arrow by the bowstring. This requires that the arms 33, 35 and 37 be sufficiently flexible to allow this slight radial movement of the arrow during projection without damage to the arrow. Again, most plastics achieve this degree of flexibility.

To allow the arrow support to be attached to the bow 13, a pair of slots 41 and 43 are provided in the frame portion of arrow support 11. These slots are disposed to allow the arrow position to be adjusted. In FIG. 2 screws 43 and 45 are shown inserted through slots 41 and 43, respectively, to rigidly connect the arrow support 11 to the back 31 of bow 13. The orientation of the slots is horizontal when the bow is disposed vertically. By utilizing this screw and slot type of attachment means, the position of the arrow for shooting can be adjusted. Furthermore, this attachment means allows the arrow support to be removed when it is not needed. This attachment and removal is facilitated since it is not necessary to remove or attach the feathered support or the leather strip which is normally contained on or about the ledge 25 as described above.

If it is desired to change the vertical placement of the arrow position, the screw positions can be altered or the arrow support 11 can be tilted prior to tightening the screws.

Figure 4:
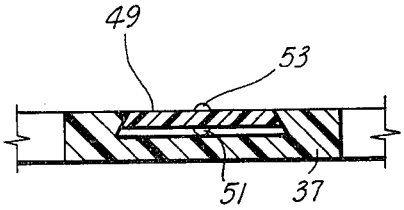
FIG. 4 is a cross sectional view of a portion of the arrow support shown in FIG. 3 taken along the lines shown in FIG. 3.

If it is desired to allow the arrow support to accomodate different diameter arrows, or to allow the arrows to be more snugly engaged between the contact points of the arms, the end of one or more of the arms can be made adjustable. As seen in FIGS. 3 and 4, arm 37 has a slide member 49 received in a slot disposed on the interior side of arm 37. The outer edges of slide member 49 are outwardly angled such that the interior of the slide member is wider than the exterior of the slide member. The edges of the slot in arm 37 are matingly angled to receive and contain the slide member 49 but yet allow the slide member 49 to move radially inwardly and outwardly. The radially innermost end of slide member 49 forms the contact point for arm 37. By adjusting the position of the slide member 49 the radial distance to the neighboring contact points can be adjusted. An interior nub 51 on the interior side of slide member 49 resiliently engages the interior wall of the slot in arm 37 to form a friction surface to retain the slide member 49 in position once a desired position has been achieved. An outer nub 53 on slide member 49 aids the manual positioning of slide member 49.

After the arrow support 11 has been connected to the bow 13 and the slide member 49 has been adjusted, an end of an arrow can be inserted through ring portion 29 and the mid-portion of the arrow urged between the contact points of arms 33, 35 and 37. The nock of the arrow is then positioned on the nocking point of the bowstring. The arrow is then in a shooting position ready to be drawn and fired.

The nock of an arrow often has an interior pair of projecting nubs which face each other and prevent the arrow from slipping off of the string. The string also often has a pair of larger diameter surfaces about the nocking point to capture the arrow once the arrow has been nocked. The combination of these two features holds the nock on the string and prevents the nock from moving out of the nocking point. By combining these features with the arrow support 11 which radially supports the mid-portion of the arrow, the arrow is retained in a ready-to-shoot position regardless of the orientation of the bow.

As mentioned before, plastic is a suitable material for this invention. However, other materials could be suitable.

If desired, a slot could be formed in the ring portion 29 to allow an arrow to be nocked without passing an end through the ring. Dotted lines 55 and 57 in FIG. 3 show where such a slot could be formed. Whether or not to use such a slot depends on the desired features, such as rigidity, ease of forming and the like.

Thus, the arrow support device of the present invention is well adapted to attain the objects and advantages mentioned as well as those inherent therein. While presently preferred embodiments of the invention have been described for the purpose of this disclosure, numerous changes in the construction and arrangement of parts can be made by those skilled in the art which changes are encompassed within the spirit of this invention as defined by the appended claims.

The foregoing disclosure and the showing made in the drawings are merely illustrative of the principles of this invention and are not to be interpreted in a limiting sense.

What is claimed is:

1. An archery bow comprising:

a bow member having a handle disposed at a midportion thereof and an open arrow rest ledge disposed adjacent said handle;

radial support means for radially supporting an arrow in a ready-to-shoot position with respect to said bow member including an exterior frame having an opening for receiving an arrow longitudinally therethrough and at least three flexible arrow support arms extending radially into said opening forming a radial enclosure for radially supporting an arrow in a ready-to-shoot position with respect to said bow member; and means for removably connecting said radial support means to said bow member such that said archery bow is functional in a conventional manner with said radial support means removed.

2. The archery bow of claim 1 wherein said arms are disposed such that at least three spaces are formed between said arms for receiving vanes of an arrow therethrough when an arrow is projected from said archery bow.

3. The archery bow of claim 1 wherein said arms are sufficiently flexible to allow radial insertion and removal of an arrow between said arms into and from said enclosure.

4. The archery bow of claim 1 wherein said frame comprises a circular ring and wherein said arms extend radially inwardly from the interior of said ring.

5. The archery bow of claim 1 wherein at least one of said arms has a movable end portion which is adjustable radially inwardly and outwardly for changing the size of said enclosure.

6. The archery bow of claim 1 wherein said radial support means includes a plate extending radially from said frame having at least one slot therein; and wherein said connecting means comprises a fastener for extending through said at least one slot into said bow member such that said radial support means is fixed to said bow member in a selected yet adjustable position along said at least one slot.

* * * * *